United States Patent [19]

Hyde

[11] Patent Number: 4,470,950

[45] Date of Patent: Sep. 11, 1984

[54] STORAGE ARRANGEMENTS FOR NUCLEAR FUEL ELEMENTS

[75] Inventor: John E. Hyde, Leicestershire, England

[73] Assignee: National Nuclear Corporation Limited, London, England

[21] Appl. No.: 317,388

[22] Filed: Nov. 2, 1981

[30] Foreign Application Priority Data

Oct. 31, 1980 [GB] United Kingdom ..... 8035169

[51] Int. Cl.[3] ..... G21F 5/00; G21F 1/00

[52] U.S. Cl. ..... 376/272; 250/506.1

[58] Field of Search ..... 376/272, 396, 404, 405, 376/298, 290; 250/506.1, 507.1

[56] References Cited

U.S. PATENT DOCUMENTS

| | | | |
|---|---|---|---|
| 3,071,527 | 1/1963 | Young | 376/396 |
| 3,073,961 | 1/1963 | Nachbar et al. | 250/506.1 |
| 3,115,215 | 12/1963 | Allen | 250/506.1 |
| 3,140,237 | 7/1964 | Peterson et al. | 376/396 |
| 3,414,727 | 12/1968 | Bonilla | 376/272 |
| 3,845,315 | 10/1974 | Blum | 376/272 |
| 3,866,424 | 2/1975 | Busey | 376/298 |
| 3,934,152 | 1/1976 | Alleaume | 250/506.1 |
| 3,968,653 | 7/1976 | Cachera | 376/298 |
| 4,061,534 | 12/1977 | Jackson | 376/298 |
| 4,115,192 | 9/1978 | Jogand | 376/290 |
| 4,171,002 | 10/1979 | Smith | 250/506.1 |
| 4,186,049 | 1/1980 | Blum | 376/298 |
| 4,229,316 | 10/1980 | Baatz et al. | 250/506.1 |
| 4,299,660 | 11/1981 | Quade | 376/298 |

FOREIGN PATENT DOCUMENTS

| | | | |
|---|---|---|---|
| 1132465 | 11/1968 | United Kingdom | 376/298 |
| 1355737 | 6/1974 | United Kingdom . | |

OTHER PUBLICATIONS

*Nuclear Reactor Eng.*, D. Van Nostrand Co., Inc. 1964, Glasstone et al., pp. 407–411.

*Primary Examiner*—Harvey E. Behrend
*Attorney, Agent, or Firm*—Kirschstein, Kirschstein, Ottinger & Israel

[57] ABSTRACT

A storage container for one or more nuclear fuel elements of the kind having a tubular storage vessel (1) within an outer jacket (11), incorporates between the walls of the container and the jacket at least two separate coolant ducts (18, 19) through which cooling fluid is arranged to be circulated by separate cooling circuits, the jacket containing a liquid, conveniently water, which is static but serves as a heat transfer medium between the storage vessel and the coolant ducts.

By utilizing at least two coolant ducts connected to separate cooling circuits, failure of one circuit will not affect the other.

10 Claims, 6 Drawing Figures

STORAGE ARRANGEMENTS FOR NUCLEAR FUEL ELEMENTS

BACKGROUND OF THE INVENTION

1. Field of the Invention

This invention relates to storage arrangements for nuclear fuel elements, and to storage containers for use therein.

2. Description of the Prior Art

One known form of storage container comprises a tubular vessel for one or more elements concentrically surrounded by an outer jacket through which water is arranged to be circulated from two independent cooling circuits.

However such an arrangement suffers from the disadvantage that should a fracture of a feed or return water pipe of one of the cooling circuits occur, water could be lost from both circuits, which is clearly undesirable.

SUMMARY OF THE INVENTION

1. Purpose of the Invention

An object of the invention is to provide a form of fuel storage container which avoids this drawback, as well as possessing other advantages as will be apparent from the following description.

2. Brief Description of the Invention

According to the invention a storage container for one or more nuclear fuel elements of the kind comprising a tubular vessel within an outer jacket, incorporates, between the walls of the vessel and the outer jacket, at least two separate coolant ducts through which cooling fluid can be circulated.

In use, the jacket is arranged to contain a liquid, conveniently water, which is static but serves as a heat transfer medium between the storage vessel and the coolant ducts. The coolant ducts are arranged to be connected to completely segregated cooling circuits so that failure of one circuit has no effect on the other. Preferably also each of the cooling circuits with its associated duct is arranged to provide, by itself, adequate cooling of a loaded vessel.

Usually, in use, the inner vessel will be in the form of a pressure vessel arranged to be filled with a gas, for example carbon dioxide, to effect the transfer of heat by convection from the fuel element or elements to the vessel wall. It will be observed that in an arrangement in accordance with the present invention any leakage of gas from the pressure vessel into the surrounding jacket will not affect the cooling circuits.

Preferably the coolant ducts are arranged to be such that even if there were to be a complete loss of liquid from the surrounding jacket circulation of cooling fluid through the ducts is adequate to prevent an unacceptable increase in temperature of the loaded pressure vessel.

The coolant ducts may be in the form of U-tubes for ease of manufacture, although they could be in the form of coils or other convenient geometry.

BRIEF DESCRIPTION OF THE DRAWINGS

One storage container in accordance with the invention will now be described by way of example with reference to FIGS. 1 to 5 of the accompanying schematic drawings, in which

FIG. 1A is an auxiliary view of the fragment of the upper portion of the storage container, the same being taken on an axial section displaced from that on which FIG. 1 is taken

Figure 1:
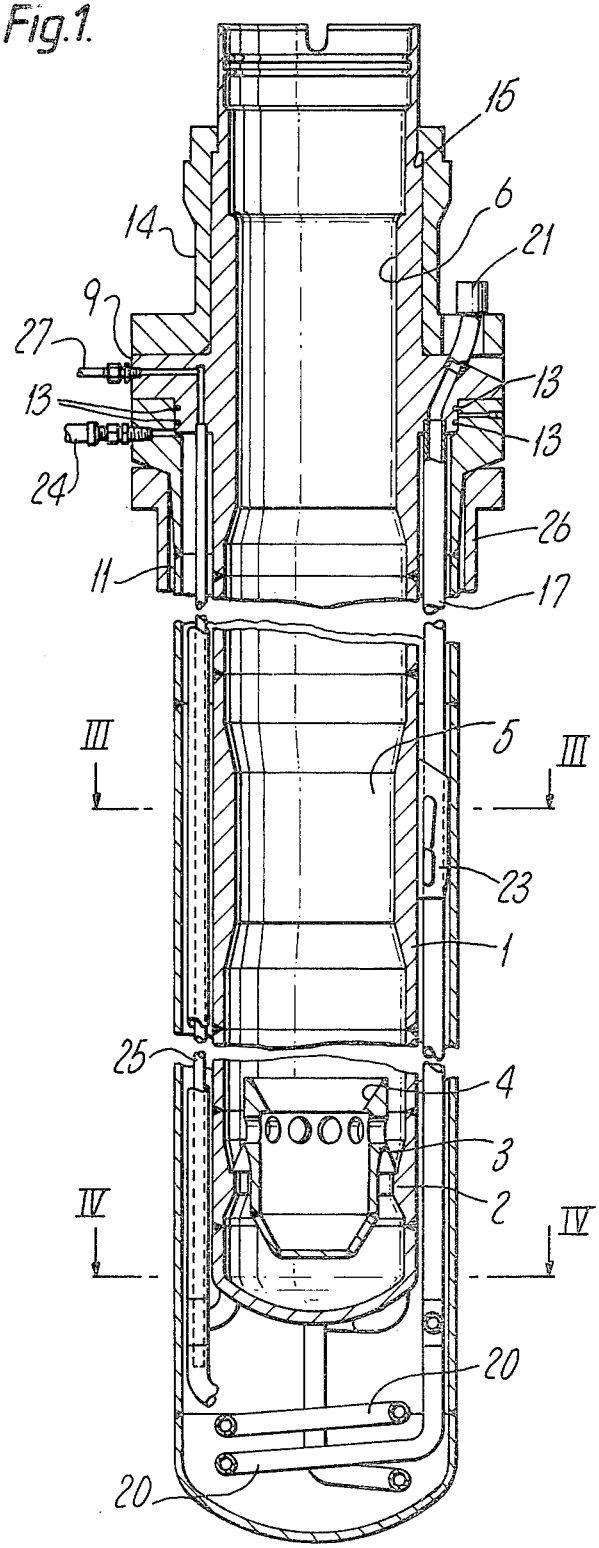
FIG. 1 represents an axial section of the storage container with portions thereof deleted in order to shorten the height of the figure.
Figure 1A:
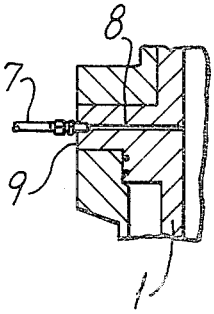

Referring to the drawings, the storage container comprises a tubular pressure vessel 1, typically of the order of 22 meters in length and 32 centimeters in external diameter. An annular internal ledge 2 near the bottom of the pressure vessel supports a debris pot 3, the rim 4 of which is chamfered inwards and provides a support for the lower end of a string of fuel elements (not shown), and internal ribs as at 5, 6 serve to centralise the fuel element string within the vessel.

In use the pressure vessel 1 is arranged to contain carbon dioxide gas at a pressure corresponding to that in the associated reactor and serves to transfer heat, by convection, from the fuel elements to the vessel wall, the carbon dioxide being introduced into the vessel by means of a pipe 7, connected to a port 8 which extends radially through a flange 9 at the upper end of the vessel auxiliary (view 1A). An outlet connection is provided at 7A (FIG. 2).

Figure 2:
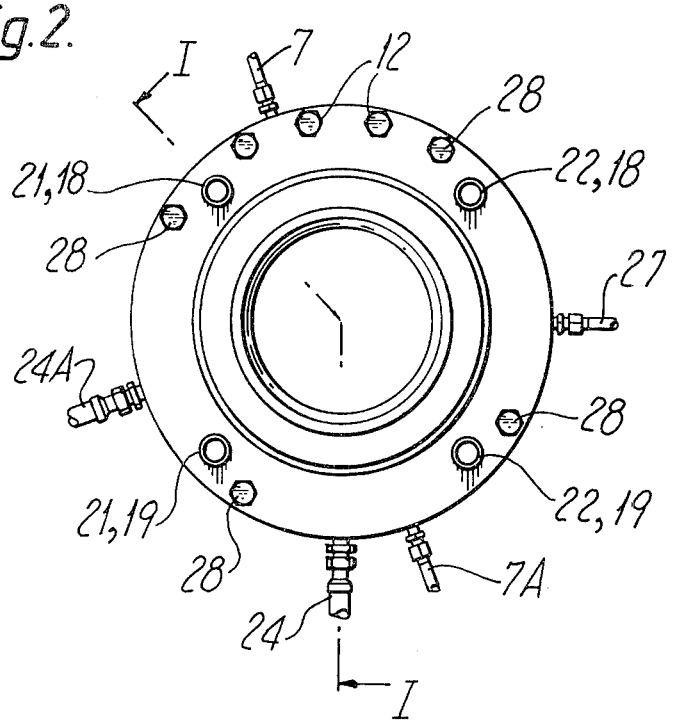
FIG. 2 represents a plan view of the container

The pressure vessel 1 is supported by the flange 9 coaxially within an outer jacket 11 and held in place by bolts as at 12 in FIG. 2 (only some of which are shown), double elastomer O-rings 13 forming a fluid-tight seal.

A flanged shroud tube 14 is bolted above the support flange 9 and is "lipped" as at 15 over the top of the pressure vessel 1 to provide secondary retention should failure of the pressure circuit occur.

Figure 5:
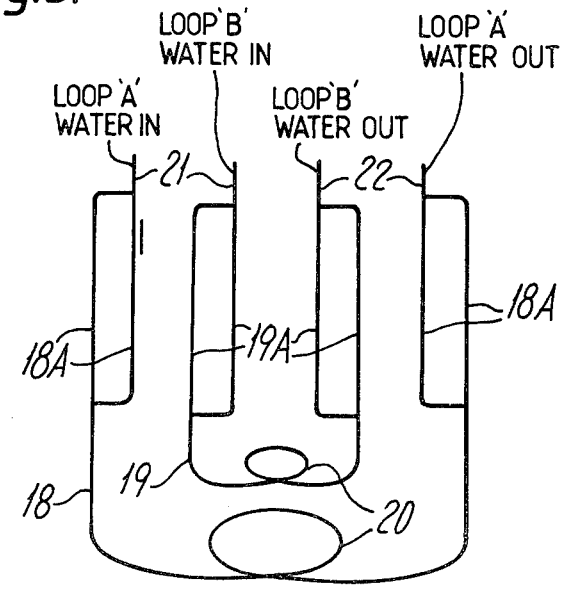
FIG. 5 is a diagrammatic view of the coolant system.

In use, fuel elements within the pressure vessel 1 are cooled by the natural convection of the high pressure carbon dioxide gas within the vessel transferring its heat to static water contained within the outer jacket 11. Heat is removed from this water by cooling water fed through 25 mm diameter pipes 17 forming two separate cooling loops 18, 19 extending the entire length of the water jacket, the two loops being shown diagrammatically in FIG. 5. Connections as at 21, 22 provide inlets and outlets for the cooling loops at the top of the water jacket 11.

Figure 3:
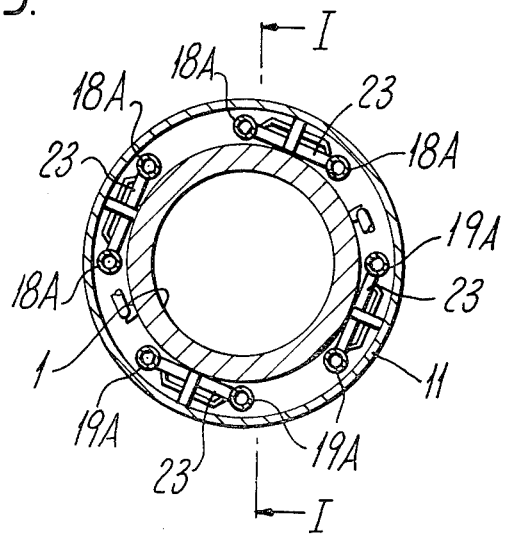
FIGS. 3 and 4 show transverse sections through different parts of the storage container.
Figure 4:
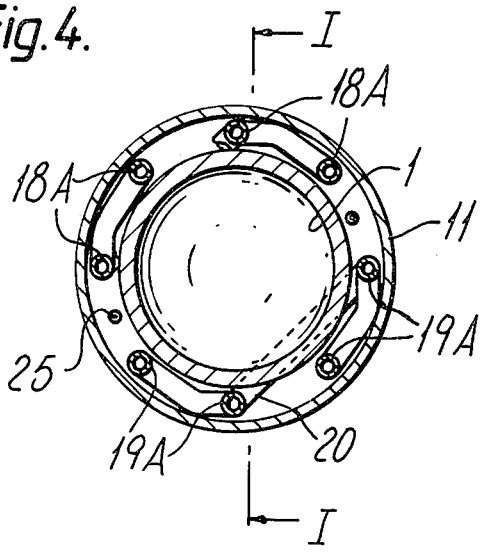

To provide sufficient heat transfer surface, the inlet and outlet sides of each of these cooling loops 18, 19 is bifurcated within the water jacket and the two bifurcated legs 18A, 19A of each loop are joined below the pressure vessel by a horizontal coil 20. This allows for differential expansion between the legs. The pipes forming the loops are welded into the upper flange 9 of the pressure vessel 1 so that the legs 18A, 19A hang downwards to provide eight axially extending coolant ducts disposed uniformly around the space between the walls of the pressure vessel 1 and outer jacket 11, as shown more clearly in FIG. 3, the pipes being held at four positions along their length by hook shaped brackets 23 welded to the outer surface of the pressure vessel 1. These brackets 23 serve to centralise the pressure vessel 1 within the outer jacket 11 as well as acting as retainers for the pipes.

The provision of two completely segregated coolant loops associated with the two cooling circuits ensures that failure of one circuit does not affect the operation of the other.

The water in the outer jacket 11 serves as a heat transfer medium between the pressure vessel 1 and the cooling loops 18, 19 and provides additional thermal capacity in the event of certain fault conditions. There is normally, in use, only one open connection (as at 24) from the top of the jacket 11, which is routed to a header tank (not shown). This allows for expansion of water within the jacket. A further connection 24A (FIG. 2) is provided for filling purposes.

The jacket water is dosed with lithium hydroxide, and the header tank is covered by a pressurised hydrogen blanket. A small bore pipe 25, connected to an outlet 27 in the flange 9, extends to the bottom of the jacket 11 to enable water to be drawn off at intervals to check the water pH value. The connections 24 and 27 are shown one above the other in FIG. 1 for clarity although these would normally be angularly displaced as in FIG. 2.

Although there is virtually no risk of leakage of water from the jacket 11, a low level water alarm is located in the header tank to provide a warning of any water losses. Nevertheless the cooling loops and associated circuits are designed to prevent an unacceptably rapid temperature rise, even with a total loss of water from the jacket surrounding a newly loaded pressure vessel.

The jacket 11 is designed for the same working pressure as the pressure vessel 1, thereby providing secondary containment. Carbon dioxide leaking into the jacket 11 will eventually bubble back into the header tank. It will be observed that any carbon dioxide leaking into the jacket 11 will not affect the cooling circuits. Nevertheless leaking of carbon dioxide into the water jacket is arranged to be detected by a monitor fitted into the feed pipe from the header tank.

Under normal conditions both cooling circuits will be operative, the highest temperatures occurring when a container has been recently loaded. The cooling circuits are arranged so that the outlet temperature of the cooling loops, having an inlet temperature of 25° C., will be of the order of 62° C. immediately after loading, the maximum water level temperature under such a condition being approximately 65° C., these temperatures falling as the fuel elements start to decay. If one cooling circuit is lost the remaining cooling circuit will prevent the water jacket temperature rising above 100° C.

To suppress boiling under such conditions the pressure in the header tank is maintained at a value equivalent to 17 meters of water.

The whole assembly of a pressure vessel 1 within its outer jacket 11 is secured by four bolts 28 to a support tube, shown in part at 26, which is welded at its lower end to a supporting grillage, the latter being designed to support a multiplicity of similar storage assemblies disposed in a number of parallel rows.

The volume between support tubes is infilled with concrete to provide shielding, but provision is made to prevent a concrete/support tube bond. Then in the case of a dropped fuel stringer the whole length of the respective support tube is available to absorb impact load as strain energy.

To reduce the amount of pipework within the store area the cooling water is fed to pairs of storage containers in series, and the make-up to the water jacket and the high pressure carbon dioxide supplies for the pressure vessels are fed to four storage containers in series.

The whole store is covered by cast iron slabs, a removable circular slab being disposed above each of the storage containers, to provide access to the pressure vessels for loading and unloading purposes.

Independent cooling circuits feed each of the two cooling loops within the water jacket of each storage container, each cooling circuit incorporating two pumps, one of which is normally in operation with the other on automatic standby. Such an arrangement gives full protection against the following faults:

(a) Failure of two pumps in addition to one out for maintenance.

(b) A single pipe failure anywhere in the circuit, and loss of a pump in the other circuit.

(c) A blockage of any pipe in a circuit and loss of one pump in the other circuit.

If flow through both loops is lost the water jacket contents will heat up but the thermal capacity of the static water within the jacket provides a buffer against short term cessation of flow.

The electrically operated water circulating pumps in each cooling circuit are supplied from independent electrical supplies. In the extremely unlikely event that both supplies are broken and are not restored in time to prevent an appreciable proportion of the water in the jacket of the most recently loaded storage container being lost due to evaporation, facilities are made for quenching the outer surfaces of the water jacket with suitably directed water jets.

I claim:

1. A storage container arrangement for storage of one or more nuclear fuel elements, said arrangement comprising in combination:

(a) an inner storage container formed as a closable gas-filled pressure vessel for containing nuclear fuel elements;

(b) an outer sealed jacket substantially completely enclosing said pressure vessel;

(c) a volume of liquid confined in, and substantially filling, the space between said outer jacket and said pressure vessel to form a liquid jacket around said pressure vessel, which space is isolated from the interior of the pressure vessel;

(d) at least two separate coolant loops disposed outside said pressure vessel and extending through said liquid jacket over at least a substantial part of the length of the jacket, and connected to respective segregated cooling circuits; and (e) at least one pumping means associated with each cooling circuit for pumping coolant fluid independently through the respective coolant loops; the coolant loops maintaining the coolant fluid therein separate from said liquid in the outer jacket.

2. A storage container arrangement as claimed in claim 1 wherein, in use, each said coolant loop is operative alone to keep the inner fluid-filled pressure vessel at a temperature below that at which it gives rise to boiling of the liquid in the outer jacket.

3. A storage container arrangement for storage of one or more nuclear fuel elements, said arrangement comprising in combination:

(a) an inner storage container formed as a closable gas-filled pressure vessel for containing nuclear fuel elements;

(b) an outer sealed jacket substantially completely enclosing said pressure vessel;

(c) a volume of liquid confined in, and substantially filling, the space between said outer jacket and pressure vessel to form a liquid jacket around said pressure vessel, which space is isolated from the interior of the pressure vessel and is externally pressurized;

(d) at least two separate coolant loops disposed outside said pressure vessel extending through said liquid jacket over at least a substantial part of the length of the jacket, and connected to respective segregated cooling circuits; and (e) at least one pumping means associated with each cooling circuit for pumping coolant independently through the respective coolant loop; the coolant loops maintaining the coolant therein separate from said liquid in the outer jacket.

4. A storage container arrangement as claimed in claim 1 in which at least one cooling circuit incorporates two or more pumps, one of which is on automatic standby.

5. A storage container arrangement as claimed in claim 4, in which each pump is powered from a separate electrical supply.

6. A storage container arrangement as claimed in claim 1 in which said liquid consists essentially of water.

7. A storage container arrangement as claimed in claim 1 wherein said gas consists essentially of carbon dioxide.

8. A storage container arrangement as claimed in claim 1 wherein said coolant consists essentially of water.

9. A storage container arrangement as claimed in claim 1 wherein, said pressure vessel and outer jacket are generally in the form of elongate substantially coaxial cylinders, and each coolant loop incorporates a pair of pipes extending substantially parallel to the common axis of said cylinders and are connected beneath the pressure vessel by a coiled section of pipe.

10. A storage container arrangement as claimed in claim 1 wherein said outer jacket is also a pressure vessel, and is capable of withstanding the same working pressure as the inner gas-filled pressure vessel.

* * * * *